US008541677B2

(12) United States Patent
Smirnov

(10) Patent No.: US 8,541,677 B2
(45) Date of Patent: Sep. 24, 2013

(54) MUSIC MACHINE

(76) Inventor: Andrei V Smirnov, Wadsworth, OH (US)

( * ) Notice: Subject to any disclaimer, the term of this patent is extended or adjusted under 35 U.S.C. 154(b) by 247 days.

(21) Appl. No.: 13/168,959

(22) Filed: Jun. 25, 2011

(65) Prior Publication Data

US 2012/0325074 A1 Dec. 27, 2012

(51) Int. Cl.
*A63H 5/00* (2006.01)

(52) U.S. Cl.
USPC ..... 84/609

(58) Field of Classification Search
USPC ..... 84/609
See application file for complete search history.

(56) References Cited

U.S. PATENT DOCUMENTS

| | | | | | |
|---|---|---|---|---|---|
| RE31,653 | E | * | 8/1984 | Takeuchi | 84/625 |
| 4,697,490 | A | * | 10/1987 | Deutsch | 84/608 |
| 4,800,794 | A | * | 1/1989 | Deutsch | 84/608 |
| 5,684,260 | A | * | 11/1997 | Van Buskirk | 84/604 |

* cited by examiner

*Primary Examiner* — Jianchun Qin

(57) ABSTRACT

This application describes a method and an apparatus which enable one to compose music using hierarchical musical scales and harmonic sequences, where each harmonic sequence of a higher level is derived from the one on the lower level. Frequencies associated with harmonic sequence on each level above the first one are obtained as multiples of the corresponding frequencies on a lower level. The sets of multipliers used to scale the frequencies between the levels is restricted to respective groups of rational numbers, or musical scales, where each level in a hierarchy of harmonic sequences can be related to its own scale, or a single scale can be used for all levels. When composing for an orchestra of multiple instruments, harmonic sequences and musical scales can be assigned independently to each musical instrument.

18 Claims, 3 Drawing Sheets

MUSIC MACHINE

Figure 1:
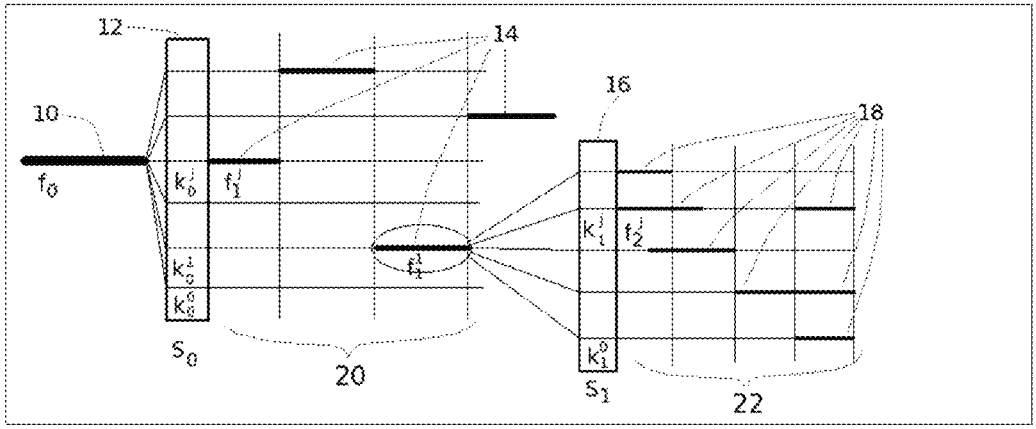

CROSS REFERENCE TO RELATED APPLICATIONS (1) Electronic keyboard musical instruments
(2) MIDI-sequencer applications

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of the Invention

This invention relates to the field of sound generation by means of electronic instruments and computers equipped with appropriate sound generation devices.

In particular, music is produced by combination of sounds of different tones, or pitches, which can be characterized by fundamental physical frequencies of sound waves. Most conventional approaches to musical composition are based on providing a time sequence of such tones, which have their frequencies in a certain relation to each-other, that makes it pleasant to the ear. In particular, the relations characterized by simple ratios, such as 2, 1/2, 3/2, 3/4, 4/3, etc. are most pleasant. This could be related to resonances caused by such frequencies inside the ear, or some more complex phenomena inside the brain.

Indeed, the earlier instruments were based on resonating strings, and were tuned to follow these ratios, which is reflected, for example, in Pythagorean scale. However, those scales have a limitation that it is impossible to build a set of octaves from those scales, spanning several orders of magnitude of the base frequency. This is the reason why, most modern instruments are based on chromatic scale, which removes this limitation by sub-dividing an arbitrary range of frequencies into equal intervals on a logarithmic scale (FIG. 2, where number above each line added to one is equal to the scaling factor used to obtain the frequency associated with that line). But by moving to a logarithmic scale, one can no longer reproduce exact ratios for most of the tones. Thus, chromatic scale compromised the purity of tones to achieve a versatility of the instrument, which enabled the development of key-based instruments, such as piano, organ, or modern music keyboards.

Another method of musical composition is based on the idea of harmony, whereby a composition is subdivided into measures, and each measure is assigned to a specific harmonic scale, which is defined as a sequence of harmonic triads or keys, that are pleasant to the ear. The well known harmonic scales are major and minor scales. When combined into a sequence, harmonic scales form a harmonic sequence, which determines the character of a song. For example, the harmonic sequence "C" (C-major), "Am" (A-minor), "F" (F-major), and "G" (G-major) is common in many popular songs.

Along with harmonic sequences, another common practice is to apply a frequency shift in a form of modulation, or transposition. In the current invention these ideas are generalized to a method of hierarchical multi-scale composition. This method provides a procedure and an outline of an instrument, which overcome the limitations of both Pythagorean and chromatic scales by unifying harmonic sequencing and modulation as a general method of hierarchical composition. This invention also generalizes the idea of a musical scale to a multi-scale composition, or multi-scale orchestra of instruments.

When a single scale is used this method simplifies performing and writing of music as compared to chromatic scale. This is because it replaces a multitude of tonic combinations for every keys by a single scale, which is a set of basic ratios. For example, instead of remembering major/minor tonic triads for every key, such as "C,E,G", "C,D#,G" for major/minor triads in C-key, etc. (total of 2*12=24 combinations), one will only remember two combinations of ratios: (1, 5/4, 3/2) for a major triad and (1, 6/5, 3/2) for a minor triad (and in fact, the first number is always 1). Shifting to different keys will amount to multiplication (modulation) of these numbers by a rational number selected from the scale used. For example, a sequence (1, 9/8, 5/4, 4/3, 3/2, 5/6, 15/8) will resemble the chromatic major scale. Shifting to different octaves amounts to multiplication by a power of 2.

(2) Description of Related Art Including Information Disclosed Under 37 CFR 1.97 and 1.98.

1. Deutsch (U.S. Pat. No. 4,697,490 A) is entitled "Musical tone generator using incremental harmonic variation".
2. Van Buskirk (U.S. Pat. No. 5,684,260 A) is entitled "Apparatus and method for generation and synthesis of audio".
3. Takeuchi (U.S. Pat. No. RE31653 E) is entitled "Electronic musical instrument of the harminic synthesis type".

BRIEF SUMMARY OF THE INVENTION

One limitation of a standard chromatic scale used in music compositions today is the inexact representation of harmonic tones, as derived from the physics of resonating strings. Harmonic frequencies of resonating strings differ by rational multipliers. Sounds combined of such frequencies are usually pleasant to the ear. This is also reflected in the earlier Pythagorean scale. However, such scale can not be easily applied to a key-based instrument, such as a piano, or an organ, because it can only span a single octave. Chromatic scale overcomes this limitation by evenly distributing the frequencies on a logarithmic scale, thus creating the possibility to use many octaves. However, this comes at a cost of compromising the purity of harmonic sounds, because frequencies produced by the keys no longer differ by rational multipliers, but rather by transcendental numbers resulting from the logarithmic operation. This makes chords played on an electronic keyboard sound less pleasant than on an acoustic piano, because the strings on the latter can self-adjust their frequencies to each-other through the resonance effect.

Another problem with a chromatic scale is a steep learning curve to master the composition and performance skills. This complexity stems from a relatively large number of tonic combinations one has to learn for each of twelve keys to play some simple scales.

The proposed invention overcomes both limitations by applying the technique of sound modulation to Pythagorean-like scales. This technique would be hard to realise on an acoustic instrument, but it can be easily implemented on electronic devices. The invention describes a method and an apparatus which enable one to compose music using hierarchical musical scales and harmonic sequences, where each harmonic sequence of a higher level is derived from the one on the lower level. Frequencies associated with harmonic sequence on each level above the first one are obtained as multiples of the corresponding frequencies on a lower level. The sets of multipliers used to scale the frequencies between the levels is restricted to respective groups of rational numbers, or musical scales, where each level in a hierarchy of harmonic sequences can be related to its own scale, or a single scale can be used for all levels. When composing for an orchestra of multiple instruments, harmonic sequences and musical scales can be assigned independently to each musical instrument.

When a single-scale is used the method simplifies writing and performing of music by reducing the 12 different scale combinations one should learn for each key in a chromatic scale to a single scale. And finally, the method opens up opportunities of exploring different musical scales that can exist within the realm of physical resonances.

BRIEF DESCRIPTION OF THE SEVERAL VIEWS OF THE DRAWING (1) Drawings

FIG. 1. Assigning frequencies through multiple scales

Figure 2:
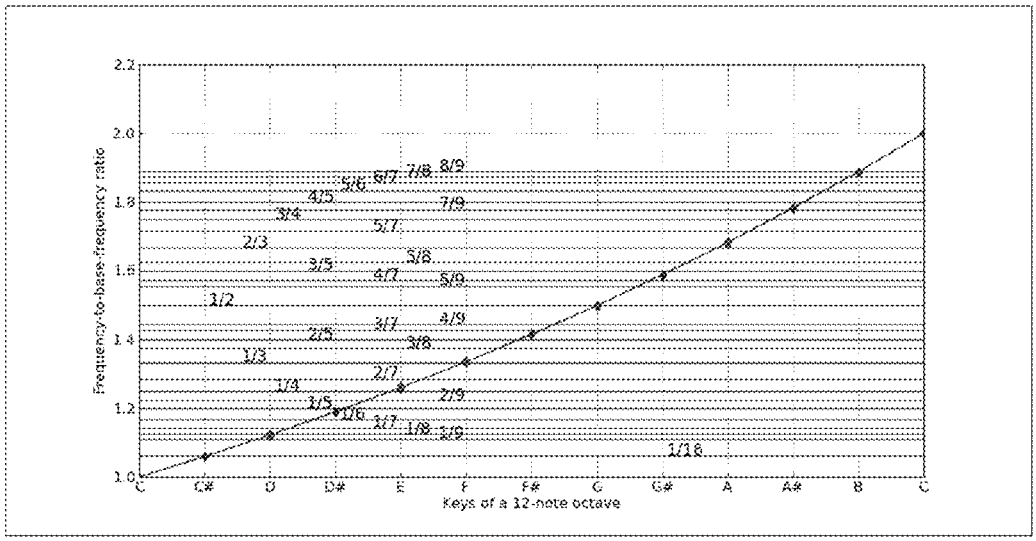

FIG. 2. Frequencies of chromatic scale

Figure 3:
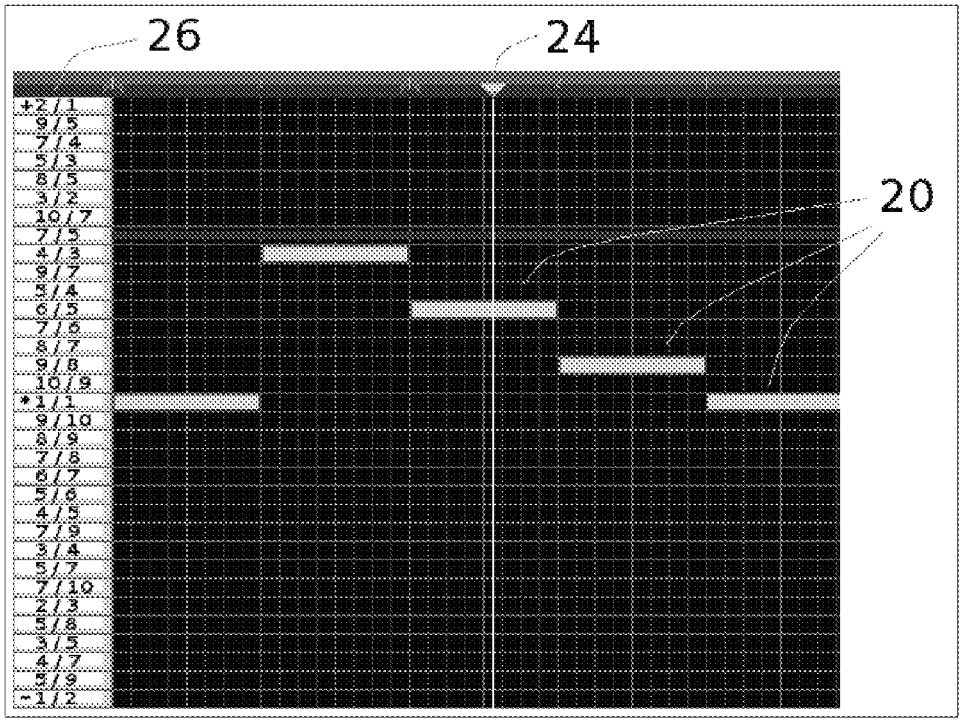

FIG. 3. Instrument scale keys in a GUI piano-roll

Figure 4:
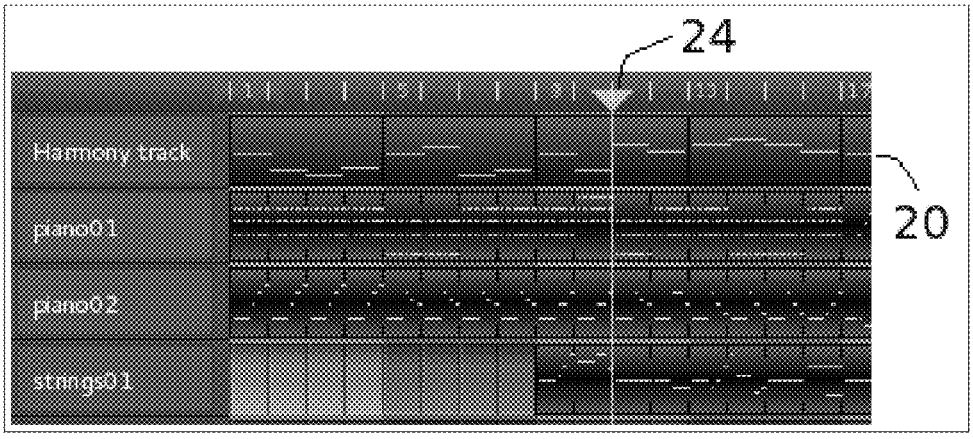

FIG. 4. Harmonic sequence shown as "Harmony track" in a GUI (2) Design Elements

10. Base frequency

12. Harmonic scale

14. Harmonic tones

16. Instrument scale

18. Notes

20. Harmonic sequence

22. Instrument score

24. Position indicator

26. Scale keys indicator panel

DETAILED DESCRIPTION OF THE INVENTION

The system of generating musical sounds is proposed where the fundamental frequency of each sound is obtained as a multiple of another frequency, which in turn can be obtained as a multiple of yet another frequency, and so on. The multipliers can be selected from a subset of rational numbers, defined by simple ratios of two integers.

In the simplest case, which we shall refer to as level-0 composition, the procedure of creating a composition starts with a single base frequency (10) and a set of rational numbers. This set of rational numbers will be further referred to as the instrument scale (16), and each number in the set will be referred to as an instrument key. Each sound in a composition is characterized by its fundamental frequency, further referred to as a note frequency, and a corresponding time interval, which together will be referred to simply as a note (18). Usually, there are other parameters comprising a note, such as a volume, but those are of no consequence for the current method, and are implicitly presumed to be given if needed. The procedure of level-0 composition sets for each time interval in a composition a corresponding note frequency equal to a product of the base frequency and one of the keys from the instrument scale. This key selection can be done independently for each sound. The time intervals can be overlapping, thus allowing for playing chords.

Next extension of this procedure, which we shall call level-1 composition, is to introduce another layer of frequencies and associated time intervals, further referred to as harmonic tones (14). In this case the intervals should be non-overlapping. The set of all harmonic tones in a composition will be referred to as the harmonic sequence (20). Each harmonic tone is determined in a similar manner as the note frequencies in level-0 composition described above. Namely, a subset of rational numbers is introduced, further referred to as the harmonic scale (12), with each number in the subset called the harmonic key. Then the procedure is to set each harmonic tone equal to a product of the base frequency and one of the harmonic keys, where the latter can be selected arbitrarily from the harmonic scale. Now, in contrast to the level-0 composition, in this case the note frequencies are determined as products of harmonic tones and instrument keys. In particular, each note frequency will be obtained as a product of one harmonic tone and one of the instrument keys, where the harmonic tone is selected such that the start-time of the note interval lies within the time interval of the harmonic tone, and the instrument key can be arbitrarily selected from the instrument scale. The selection of a harmonic tone for each note is always possible and unique, because the time intervals of harmonic tones are restricted to be non-overlapping and to span the hole time of the composition, with a possible exception of pause intervals.

The level-1 composition procedure is essentially a generalization of what is known to musicians as modulation. One can generalize the above procedure further to level-N composition through an N-step frequency transformation which is specified for each time, t, in the composition, as:

$$f_{n+1}(t)=f_n(t)*k_n(t)$$

where the initial frequency, $f_0$, or the base frequency will be a time-constant: $f_0(t)=\text{const}$, and keys, $k_n(t)$ at time, t, and each level n are selected from the corresponding n-level scale, $S_n$, as:

$$k_n(t)=\hat{R}_n^{(t)}(S_n) \tag{1}$$

where $\hat{R}_n^{(t)}$ denotes a generally time-dependent selection operator provided by a composer or an algorithm. This procedure is illustrated in FIG. 1 for the case of level-2 composition, where $f_i^j$ represent j-th frequency on i-th level, and $k_i^j$ represent j-th key in i-th scale, $S_i$. The above requirement of non-overlapping time intervals in a harmonic sequence means with regard to Eq.1 that only the highest level selection operator, $\hat{R}_{max(n)}^{(t)}$, is allowed to generate multiple selections for the same value of t, thereby producing chords.

As it follows from the above, this method of composing music generates frequencies that are exact ratios of the base frequencies. This is in contrast to a conventional chromatic scale, in which the frequencies deviate from exact ratios of the base frequency with only few exceptions as illustrated in FIG. 2. From the perspective of physical reality of resonances and wave harmonics, frequencies produced as pure ratios of the fundamental frequency are more natural, and therefore tend to be more pleasant to human ear, which is indeed confirmed by the traditional rules of harmony.

As mentioned in the background section, the limitation of Pythagorean scale is in its inability to reproduce the same sequence of tones in different octaves. In the proposed method this limitation is overcome by introducing a generalized modulation as a system of multiple scales, and harmonic sequences. In this new framework it is now possible to shift, or transpose, the base frequency to any value, and do so independently for different instruments, and thereby play the same sequence of tones in different octaves, or indeed in any new frequency range, and still retain a simple rational scaling of the base frequency. It should be noted that such modulation can not be easily accomplished on traditional instruments, and thus, the proposed method is mostly adaptable to electronic instruments, computers, and other sound-capable digital devices.

The key principles outlined above are represented in the following Claims of this invention. Since going beyond level-3 composition will probably not be very practical, these claims only cover three first levels of hierarchical compositions. In particular, the first independent Claim 1 describes a procedure of generating a sequence of sounds from a number of predetermined frequencies, called harmonic tones, which are uniquely assigned for each time interval of the composition, forming a harmonic sequence. This harmonic sequence can be seen as a pre-determined sequence of modulations assigned to pre-determined time-intervals in the composition. The harmonic sequence determines a sequence of tones from which each of the sequence of notes is obtained, producing an instrument score (22). For each harmonic tone a sequence of note frequencies can be generated by a simple scaling, where the scaling factors are rational numbers, that is, each such number is determined by a quotient of two integers. The set of these rational numbers can be fixed, in which case it is called the instrument scale. The process of selecting these scaling factors, or multipliers, is not essential as far as this invention is concerned, and is left to the composer or a computer algorithm. These claims essentially extend the idea of Pythagorean-like scales with the concept of generalized modulation based on multiple musical scales.

Claim 2 describes the level-2 composition as outlined above, where the harmonic tones are selected from a predefined subset of numbers, where each number is obtained as a multiple of a base frequency and a multiplier selected from a predetermined subset of rational numbers, called the harmonic scale.

Claims 3,4,5 extend the procedure to level-3 composition by introducing another set of frequencies, which define a harmonic sequence on a different level. This new frequencies can be selected from the same harmonic scale as in Claim 5, or a new scale can be introduced for that composition level as in Claim 4. The harmonic sequence on the higher level is derived from the one on the lower level by the same scaling procedure as described above. The harmonic scales on different levels can be setup independently from each other, however it would seem most practical to use just one harmonic scale on all levels.

The claims described so far dealt with a process of composing for a single instrument. Claims 6,7 extend this procedure to an orchestra composed of different instruments, each identified by its distinct timbre. The mentioned capability of playing different instruments is commonly implemented via different synthesizer modules in electronic instruments or instrument libraries in software implementation on a PC. In Claim 6 each instrument played on a device is capable of following its own harmonic sequence and in Claim 7 each instrument can use its own instrument scale. This goes beyond a conventional orchestra, where each instrument, even though following an individual score, is restricted to play in the common scale, following a common harmonic sequence, and obeying a common modulation, if any. It can be noted that introducing such individual scales and/or harmonic sequences can simplify instrument scores, which can be of a special advantage in algorithmic compositions.

The next set of claims describe a corresponding musical instrument, and orchestra that implement the procedure of multi-scale composition described above. In particular, the independent Claim 8 describes a sound capable device that can also set a frequency of each sound based on two sets of numbers: a harmonic tone, uniquely assigned to each time interval of the composition, and an arbitrary selected multiplier to produce each sound frequency when multiplied with the harmonic tone. The first means used to assign a set of harmonic tones can be implemented as a digital memory device controlled through a specialized input panel of a graphical user interface (GUI). The possible note frequencies generated by the device are restricted to a specific set of frequencies, produced from the harmonic tones by scaling the latter with rational multipliers. That set of multipliers is referred to as instrument scale. The second means to set the frequency of each sound can be implemented as a simple multiplication operation in a software running on a device with additional logic for selecting harmonic tones from the appropriate time intervals. The manner in which the selection from the instrument scale is done is irrelevant for this application, and can, for example, be supplied as a pre-defined composition score.

In Claim 9 a similar restriction is applied to the set of harmonic tones themselves by introducing the harmonic scale. It should be noted that in different implementations the instrument and/or harmonic scales can be defined as a set of frequencies instead of rational numbers, or a set of pairs of integers forming a quotient. For example, an instrument scale can be given as a set of dimensional frequencies in Hz, all produced as multiples of a base frequency. In this case the note frequencies will be determined by the appropriate normalization of that set of frequencies and subsequent scaling. The net result will still be the same as using a rational set of numbers as an instrument scale. The same will relate to the harmonic scale. In practice the most convenient representation of instrument and harmonic scales would be to use a pair of integers for the numerator and the denominator of the respective fractions defining the scale keys. The tone harmonization means mentioned in the claim can be implemented as a multiplication operation on in digital circuit supplemented with the interval selection procedure. The interval selection can be done according to a pre-defined composition score, or by musician's choice during a performance.

Claim 10 describes a music instrument or a computer software, which can memorize the harmonic sequence and keep it in memory for the duration of the composition. This will be similar to keeping in device memory the harmonic sequence of the song, however, in this case the harmonic sequence is replaced by the concept of generalized modulation in form of harmonic tones, produced by scaling of the lower level frequency, as opposed to harmonic chords in the chromatic scale. Modulation means can be implemented as a sequencer device which at any given time will select a harmonic tone from the harmonic sequence corresponding to the currently played time interval.

Claims 11,12 extend the capabilities of the device to level-3 compositions, where three levels of frequency modulation become possible. The global transposition means mentioned in the claim can be implemented as a multiplication operation on in digital circuit supplemented with the selection from the composition scale. The latter can be done using simple keys, buttons, or various selection tools in a software GUI. The interval selection can be done according to a predefined composition score, or by a musician choice during a live performance.

Claims 14,15,13 extend the concept of multi-scale composition devices described above to an orchestra, which is a device capable to generate sounds of different timbre as played by different instruments. Orchestra means in Claims 13,14,15 can be implemented in different sound-generating circuits, or respective software synthesizer modules as is commonly done in commercial synthesizers and MIDI sequencer programs. In particular, in an orchestra of Claim 14 each instrument of the orchestra is allowed to have its own base tone, or base frequency selected as a multiple of the global base frequency, which is the reference frequency of the orchestra, such as, 440 Hz usually assigned to note A in Chromatic scale. The instrument transposition means to set a base frequency for each instrument can be implemented as a turn-key on a control panel or a corresponding selection tool in a software GUI.

In Claim 15, the above idea of different base frequencies is extended to allow different harmonic sequences for different instruments. The set of all harmonic sequences is called the composition harmony, and each instrument can follow its own harmonic sequence selected from the composition harmony.

In Claim 13 instead of a single instrument scale there is a number of such scales, called collectively the orchestra scale, and each instrument can use its individual instrument scale to produce note frequencies. The third means to enter the orchestra scale in Claim 13 can be implemented as adequate controller devices or a software GUI. Likewise instrument harmonization means in the Claim 13 and instrument sequencing means in Claim 15 can be implemented in a suitably designed GUI panel, extending the basic panel shown in FIG. 3.

The possibility of displaying the progress of the performance within the harmonic sequence is described in Claim 16, where fourth means could be implemented as a liquid-crystal display embedded into a musical instrument, or a GUI-based panel shown in FIG. 3 and in FIG. 4 where the harmonic sequence (20) is shown as "Harmony track" in a prototype GUI panel, with the current position indicator (24).

It is important to have means of displaying the fractions from which the various scales are built. Claims 17,18 describe the possibility of displaying the scale keys as a numerator and denominator integers comprising the fractions of which the scales are defined. The third means can be implemented as a vertical bar in a piano-roll editor GUI-panel (26), replacing a piano keyboard with appropriate integer labels as shown in a snapshot of an experimental software prototype in FIG. 3.

The invention claimed is:

1. A method for playing a musical composition, comprising:

(a) providing a musical device which is an electronic device or a combination of electronic devices and which is equipped with electronic memory and is capable of generating sounds at different fundamental frequencies, (b) storing in said musical device an instrument scale, which is a predetermined subset of rational numbers, (c) storing in said musical device a harmonic sequence which is a sequence of harmonic tones, where each harmonic tone is a number selected from a range of audible frequencies and assigned to a time interval within the composition, and said time intervals such that all intervals are non-overlapping and span the whole composition in a manner that the start of the first time interval is equal to the start time of the composition, the end of the last time interval coincides with the end time of the composition, and the end of each time interval except the last one coincides with the start of the subsequent time interval, (d) storing in said musical device an instrument score which is a sequence of notes, where each note comprising a note frequency and associated note time interval, and where said note frequency is set equal to the product between a harmonic tone selected from said harmonic sequence and a number selected from said instrument scale, and said note time interval is selected such that the start of the interval lies inside the time interval of said harmonic tone, (e) generating sounds with said musical device at fundamental frequencies and during time intervals given by respective note frequencies and note time intervals as specified in a sequence of notes selected from said instrument score, whereby said musical device will play sounds as specified by said instrument score.

2. The method of claim 1 further comprising the steps of:

(a) storing in said musical device a base frequency, which is a number selected from the range of audible frequencies, (b) storing in said musical device a harmonic scale, which is a predetermined subset of rational numbers, (c) computing each harmonic tone in said harmonic sequence as a product between said base frequency and a number selected from said harmonic scale.

3. The method of claim 2 wherein said base frequency is set to different values at different times in the composition.

4. The method of claim 3 further comprising the steps of:

(a) storing in said musical device a main frequency, which is a number selected from the range of audible frequencies, (b) storing in said musical device a composition scale, which is a predetermined subset of rational numbers, (c) computing said base frequency at any time in the composition as a product between said main frequency and a number selected from said composition scale.

5. The method of claim 4 wherein said composition scale is selected the same as said harmonic scale.

6. The method of claim 2 further comprising the steps of:

(a) providing a capability for said musical device to play different musical instruments, (b) storing in said musical device a composition harmony, which is a set of said harmonic sequences, (c) mapping each instrument of said musical device to a harmonic sequence selected from said composition harmony to obtain a composition map, (d) storing said composition map in said musical device, whereby each instrument played by said musical device follows its own harmonic sequence.

7. The method of claim 2 further comprising the steps of:

(a) providing a capability for said musical device to play different musical instruments, (b) storing in said musical device an orchestra scale, which is a set of different instrument scales, (c) mapping each instrument of said musical device to an instrument scale selected from said orchestra scale to obtain an orchestra map, (d) storing said orchestra map in said musical device, whereby each instrument played by said musical device uses its own instrument scale.

8. An apparatus for playing a musical composition, comprising:

(a) a device for generating sounds at different fundamental frequencies, (b) first means to associate a harmonic tone, which is an arbitrary number, with any time interval of the composition, (c) memory to store for the entire time of the composition an instrument scale, which is a predetermined subset of rational numbers, (d) second means to set the frequency of sound generated by said apparatus within any time interval of the composition to the product between said harmonic tone associated with that time interval and a number selected from said instrument scale, whereby the frequency of sound generated by said musical device will be determined by a selection from said instrument scale.

9. The apparatus of claim 8 further including:

(a) memory to store a base frequency, which is an arbitrary number, (b) memory to store a harmonic scale, which is a predetermined subset of rational numbers, (c) tone harmonization means to set said harmonic tone at any time in the composition to the product between said base frequency and a number selected from said harmonic scale, whereby the frequency of each sound generated by said musical device will be determined by one selection from said harmonic scale and one selection from said instrument scale.

10. The apparatus of claim 9 wherein said base frequency is set to different values at different times in the composition.

11. The apparatus of claim 10 further including:

(a) memory to store a main frequency which is a number selected from the range of audible frequencies, (b) memory to store a composition scale which is a predetermined subset of rational numbers, (c) global transposition means to set said base frequency equal to the product between said main frequency, and a number selected from said composition scale, whereby the fundamental frequency of each sound generated by said musical device will be determined by one selection from said composition scale, one selection from said harmonic scale, and one selection from said instrument scale.

12. The apparatus of claim 10 further including:

(a) orchestra means to generate sounds of different instruments, (b) instrument transposition means to set said base frequency to different values for different instruments.

13. The apparatus of claim 10 further including:

(a) orchestra means to generate sounds of different instruments, (b) additional memory to store a composition harmony which is a predetermined set of said harmonic sequences, instrument sequencing means to map each instrument to one harmonic sequence selected from said composition harmony, whereby each instrument will follow its own harmonic sequence.

14. The apparatus of claim 9 further including third means to display said harmonic scale, where each rational number in said harmonic scale is indicated by two integer numbers, corresponding to the numerator and denominator of the quotient, defining this rational number.

15. The apparatus of claim 8 further including:

(a) memory to store a harmonic sequence which is a predetermined set of said harmonic tones, where each harmonic tone is associated with a time interval, and all time intervals are non-overlapping and span the whole composition, so that the start of the first time interval is equal to the start time of the composition, the end of the last time interval coincides with the end time of the composition, and the end of each time interval except the last one coincides with the start of the subsequent time interval, (b) modulation means to set the frequency of a sound generated by said musical device at any time during the composition equal to a harmonic tone selected from said harmonic sequence for the time interval which includes the current time in the composition, whereby the frequency of each sound generated by said musical device will be determined by one selection from said instrument scale and by a harmonic tone corresponding to the current time in the composition selected from said harmonic sequence.

16. The apparatus of claim 15 further including fourth means to display any part of said harmonic sequence including the whole sequence as well as to indicate current time position within said harmonic sequence when playing a composition.

17. The apparatus of claim 8 further including:

(a) orchestra means to generate sounds of different instruments, (b) additional memory to store an orchestra scale, which is a set of said instrument scales, (c) third means to input said orchestra scale into said additional memory, (d) instrument harmonization means to map each instrument to an instrument scale selected from said orchestra scale, whereby said musical device will play each instrument using a different instrument scale.

18. The apparatus of claim 8 further including third means to display said instrument scale, where each rational number in said instrument scale is indicated by two integer numbers, corresponding to the numerator and denominator of the quotient, defining this rational number.

* * * * *